US007736211B2

(12) United States Patent
Marzetta

(10) Patent No.: US 7,736,211 B2
(45) Date of Patent: Jun. 15, 2010

(54) CONSTRUCTION SYSTEM

(75) Inventor: Michael Marzetta, Spokane Valley, WA (US)

(73) Assignee: Minds-I, Inc., Liberty Lake, WA (US)

( * ) Notice: Subject to any disclaimer, the term of this patent is extended or adjusted under 35 U.S.C. 154(b) by 390 days.

(21) Appl. No.: 11/290,333

(22) Filed: Nov. 29, 2005

(65) Prior Publication Data

US 2007/0123137 A1 May 31, 2007

(51) Int. Cl.
*A63H 33/12* (2006.01)
*A63H 33/06* (2006.01)
*A63H 33/04* (2006.01)
*A63H 33/00* (2006.01)

(52) U.S. Cl. ..... 446/122; 446/121; 446/113; 446/85

(58) Field of Classification Search ..... 446/85, 446/86, 102, 105, 112, 113, 117, 120–125, 446/128; 411/349, 509, 45–48
See application file for complete search history.

(56) References Cited

U.S. PATENT DOCUMENTS

| | | | | |
|---|---|---|---|---|
| 826,621 | A | 7/1906 | Sticht | |
| 1,248,068 | A | 11/1917 | Brunel | |
| 2,537,621 | A | 1/1951 | Busom | |
| 2,885,822 | A | 5/1959 | Onanian | |
| 2,898,798 | A | 8/1959 | Carno | |
| 3,112,547 | A | 12/1963 | Poe | |
| 3,159,440 | A | 12/1964 | Courtwright | |
| 3,192,738 | A | 7/1965 | Charles et al. | |
| 3,205,611 | A | 9/1965 | Onanian | |
| 3,229,334 | A | 1/1966 | Thome | |
| 3,378,219 | A | 4/1968 | Biesecker | |
| 3,406,431 | A | 10/1968 | Armstrong et al. | |
| 3,469,339 | A | 9/1969 | Thomas | |
| 3,538,940 | A | 11/1970 | Graham | |
| 3,568,263 | A | 3/1971 | Meehan | |
| 3,611,609 | A | 10/1971 | Reijnhard | |
| 3,657,838 | A | 4/1972 | Hanning et al. | |
| 3,659,376 | A * | 5/1972 | Fischer | 446/112 |
| 3,697,104 | A | 10/1972 | Soulie et al. | |
| 3,699,709 | A | 10/1972 | Schmidt | |
| 3,744,101 | A | 7/1973 | Gley | |
| 3,755,959 | A | 9/1973 | Boberg | |

(Continued)

FOREIGN PATENT DOCUMENTS

| | | |
|---|---|---|
| WO | WO 2006/045068 | 4/2006 |

OTHER PUBLICATIONS

Office Action dated Jul. 10, 2008 for U.S. Appl. No. 11/443,446.

(Continued)

*Primary Examiner*—Gene Kim
*Assistant Examiner*—Alyssa M Hylinski
(74) *Attorney, Agent, or Firm*—Wells St. John P.S.

(57) ABSTRACT

A construction system is described and which includes a construction element having at least one passageway extending therethrough; a fastener body telescopingly received in the passageway; and a locking member cooperating with the fastener body and which, in a first position, allows the fastener body to be received in the passageway, and in a second position, substantially impedes the removal of the fastener body from the passageway.

5 Claims, 11 Drawing Sheets

U.S. PATENT DOCUMENTS 3,811,219 A * 5/1974 Fischer ..... 446/107
3,837,754 A 9/1974 Malcik
3,918,130 A 11/1975 Poe
3,975,858 A 8/1976 Much
4,007,516 A * 2/1977 Coules ..... 411/349
4,057,886 A 11/1977 Brass
4,114,509 A 9/1978 Poe
4,137,115 A 1/1979 Lambert
4,300,850 A 11/1981 de la Haye et al.
4,405,272 A 9/1983 Wollar
4,425,049 A 1/1984 Travis
4,531,870 A 7/1985 Moryl et al.
4,551,110 A * 11/1985 Selvage et al. ..... 446/118
4,589,853 A 5/1986 Hidvegi
4,599,011 A 7/1986 Tashiro et al.
4,674,930 A 6/1987 Poe et al.
4,729,606 A 3/1988 Narita et al.
4,805,365 A 2/1989 Bastian
4,823,532 A 4/1989 Westerburgen
4,881,843 A * 11/1989 Randleman ..... 403/92
5,009,599 A 4/1991 Mueller
5,049,104 A 9/1991 Olsen
5,322,466 A * 6/1994 Bolli et al. ..... 446/121
5,346,349 A * 9/1994 Giovannetti ..... 411/549
5,421,556 A 6/1995 Dodge et al.
5,568,675 A * 10/1996 Asami et al. ..... 24/453
5,823,700 A 10/1998 Poworoznek
5,839,938 A 11/1998 Manthei et al.
5,878,802 A * 3/1999 Richter et al. ..... 160/135
5,881,515 A 3/1999 George
5,928,051 A 7/1999 Krog
5,938,497 A * 8/1999 Mott ..... 446/122
5,964,635 A 10/1999 Krog
6,045,309 A 4/2000 LeVey
6,139,214 A 10/2000 Zirps et al.
6,301,747 B1 10/2001 Parein
6,461,215 B1 * 10/2002 Kunz et al. ..... 446/107
6,481,942 B2 * 11/2002 Tanaka ..... 411/45
6,540,461 B1 * 4/2003 Hawang ..... 411/48
6,595,825 B1 * 7/2003 De Wilde ..... 446/102
6,682,385 B2 1/2004 Atzen et al.
6,736,691 B1 5/2004 Bach

OTHER PUBLICATIONS

Office Action dated Jul. 17, 2008 for U.S. Appl. No. 11/526,264.

* cited by examiner

CONSTRUCTION SYSTEM

TECHNICAL FIELD

The present invention relates to a construction system, and more specifically to a construction system which includes construction elements and a fastener which are particularly useful in constructing toys and hobby crafts of various designs, and arrangements.

BACKGROUND OF THE INVENTION

Children and hobbyists have long enjoyed creative toys which have allowed the individual to construct various items of interest such as boxes, small houses, bridges, airplanes, boats, and the like. Examples of such products have included the Erector™ Set, and various LEGO™ kits that are provided at various levels of complexity. In the so-called Erector™ products, these toys have included a series of plates and bars with holes in them which are subsequently joined together with nuts and a corresponding bolt. Other creative toys have included somewhat similar building units, but have further used wooden pegs to join the building units together.

The prior art is replete with numerous examples of similar creative toys. For example, in U.S. Pat. No. 4,057,886, a toy construction system having reusable distensible joining members is shown. In this particular patent, a releasable fastener is useful in an Erector™ type toy and which further has a toy like device which appears as a riveting device and which utilizes a bullet-shaped, soft distensible rubber piece which may pass through adjoining members thereby fastening them together. This is best understood by reference to FIG. 3, of that patent. In addition to the foregoing, U.S. Pat. No. 6,736,691 to Bach relates to a toy building set with interconnecting means and which is of the form typical of the LEGO™ type toys. In this reference, block-shaped building elements are disclosed, and which at least have one passageway formed therein. Further, elements are provided that have a tenon that can be introduced into mating tubular openings in a snap-like effect thereby joining the box-like elements together.

While these various creative toys and toy construction systems have operated with a great deal of success, various shortcomings have detracted from their usefulness. For example, in the LEGO™ type building toys and/or systems, various kits are provided that will allow a hobbyist, or child to create various objects of interest such as helicopters, airplanes, boats and the like. However, many kits typically do not allow the child or hobbyist to make more than a limited number of designated objects from that provided for in the kit. Another additional shortcoming in these kits, which have been supplied heretofore, is the construction elements that are utilized with same are often releasably affixed, one relative to the others at predetermined fixed angles. Additionally, many of the construction elements are not readily rotatable, one relative to the other. Moreover, in these same toys or kits, the amount of mechanical functionality that can be imparted to same is often extremely limited. More specifically, many of these previous products fall apart when moderate force is applied to same. This might be occasioned when an individual plays with one of these kits.

While construction systems such as the Erector™ type sets allow for the positioning of construction elements in various angular orientations, they do not readily adapt themselves to allow of the construction elements supplied to freely rotate one about the other.

Therefore, a construction system which avoids the shortcomings attendant with the prior art devices and practices utilized heretofore is the subject matter of the present application.

SUMMARY OF THE INVENTION

A first aspect of the present invention relates to a construction system, which includes a construction element which has at least one passageway which extends therethrough; a fastener body telescopingly received, at least in part, in the passageway, and which extends, at least in part, outwardly relative to the construction element; and a locking member cooperating with the fastener body and which, in a first position, allows the fastener body to be telescopingly received, at least in part, within the passageway defined by the construction element, and in a second position, substantially impedes the removal of the fastener body from the passageway defined by the construction element.

Another aspect of the present invention relates to a construction system, which includes a first construction element having a first passageway formed therein, and which extends therethrough, and wherein a first orientation groove communicates with, and extends, at least in part along, the first passageway; a second construction element having a second passageway formed therein, and which extends therethrough, and wherein a second orientation groove communicates with, and extends, at least in part along, the second passageway, and wherein the first and second passageways have substantially similar cross sectional dimensions; a fastener body having a resiliently deformable first end, an opposite second end, and an intermediate portion located between the first and second ends, and wherein the fastener body defines a longitudinally extending passageway which extends between the first and second ends, and wherein the fastener body has an outside diametral dimension at the first and second ends which is less than about the maximum inside diametral dimension of the respective passageways defined by the first and second construction elements, and an intermediate portion diametral dimension which is less than the maximum outside diametral dimension of the first and second end of the fastener body, and wherein the fastener body is telescopingly received, at least in part, in each of the first and second passageways defined by the respective construction elements, and wherein a tongue is made integral with the intermediate portion of the fastener body and extends outwardly relative thereto, and wherein the tongue is received, at least in part, in at least one of the first or second orientation grooves, and wherein the tongue substantially impedes the rotation of the first and/or second construction members about the intermediate portion of the fastener body; and a locking member having a main body with opposite first and second ends and which is telescopingly received within the longitudinally extending passageway defined by the fastener body, and which moveably and matingly cooperates with the fastener body, and wherein the main body of the locking member is linearly and rotatably moveable along a course of travel defined by the fastener body from a first position which permits the first end of the fastener body to be deformed and pass through the respective first and second passageways as defined by the first and second construction elements, and the intermediate portion of the fastener body to be received within each of the respective first and second passageways as defined by the respective first and second construction elements, and a second position, wherein the locking member is wholly received within the longitudinally extending passageway as defined by the fastener body and which impedes the removal of the fastener body from the first and second passageways.

These and other aspects of the present invention will be described in greater detail hereinafter.

BRIEF DESCRIPTION OF THE DRAWINGS

Preferred embodiments of the invention are described below with reference to the following accompanying drawings.

FIG. 14 is a perspective, side-elevation view of a fastener body and locking member of the present invention and which is shown in yet another third, operational position.

FIG. 15 is a perspective, side-elevation view of the construction system of the present invention and with some underlying surfaces removed to show the structure thereunder.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 11:
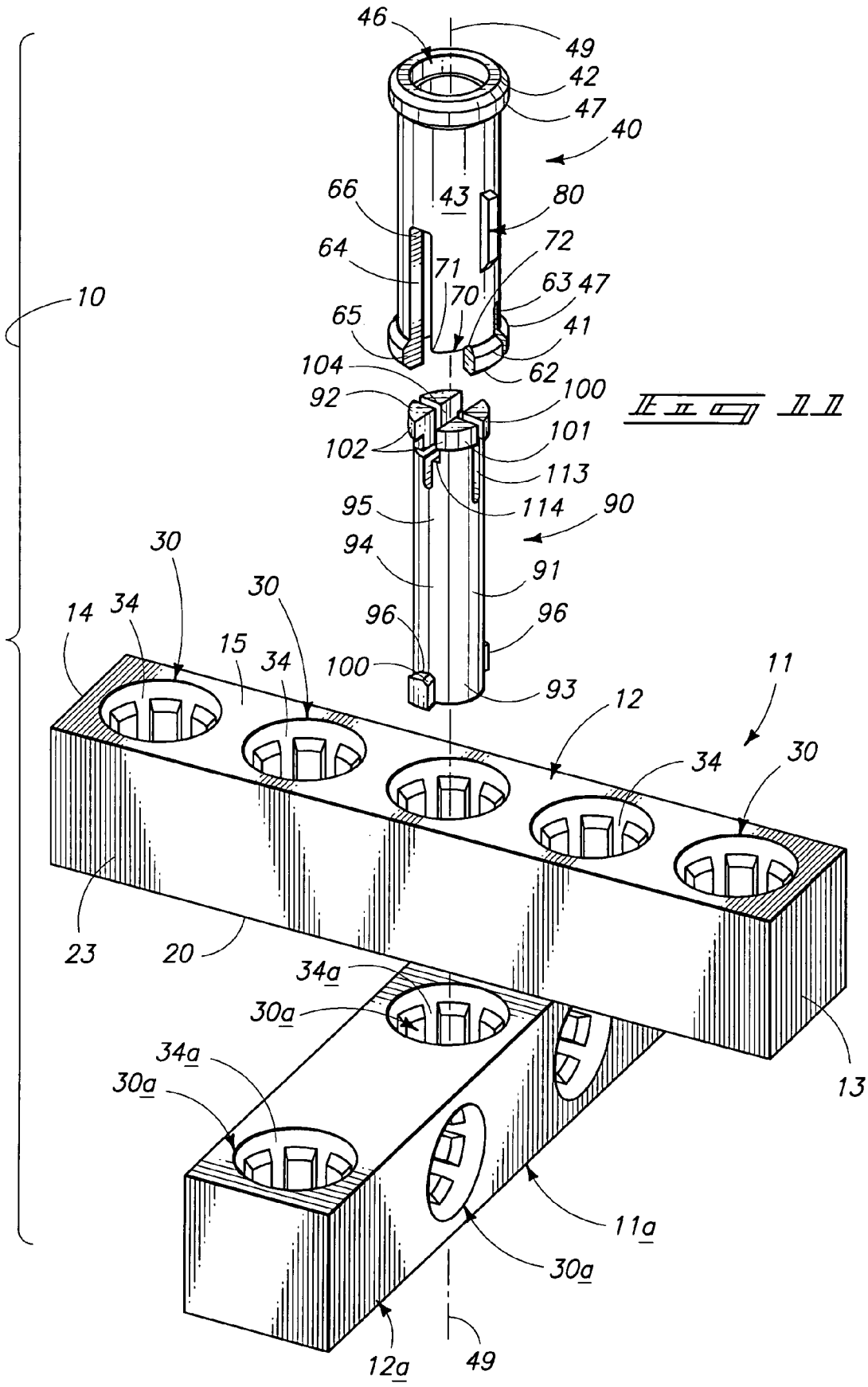
FIG. 11 is a perspective, exploded, side-elevation view of the construction system of the present invention.

The construction system of the present invention is generally indicated by the numeral 10 in FIGS. 11 and 15, respectively. Referring now to FIGS. 3-6, the construction system 10 of the present invention includes a construction element which is generally indicated by the numeral 11 therein. The construction element of the present invention includes a main body 12 having opposite first and second ends 13 and 14; a top surface 15; and a bottom surface 20. In the arrangement as seen in FIGS. 3-6, the construction element 11 assumes the form of a narrowly rectangular block-like member, however it should be appreciated that the construction element may take on assorted different forms and shapes including cylindrical, and other non-rectangular shaped forms as will become apparent from the discussion which follows. For example, one possible arrangement for the shape of the main body 12 may include a block-like member and wherein the main body 12 has an arched or curved shaped form. Additionally, it should be recognized and while the block is shown having a narrowly rectangular shape, it should be appreciated that the main body 12 may itself assume different configurations such as being formed into a square, curve, round, s-shape or l-shape forms depending upon the intended use of the construction element. Therefore, it should be understood that FIGS. 3-6 are merely illustrative of only one possible form of the construction element 11 of the present invention.

Figure 3:
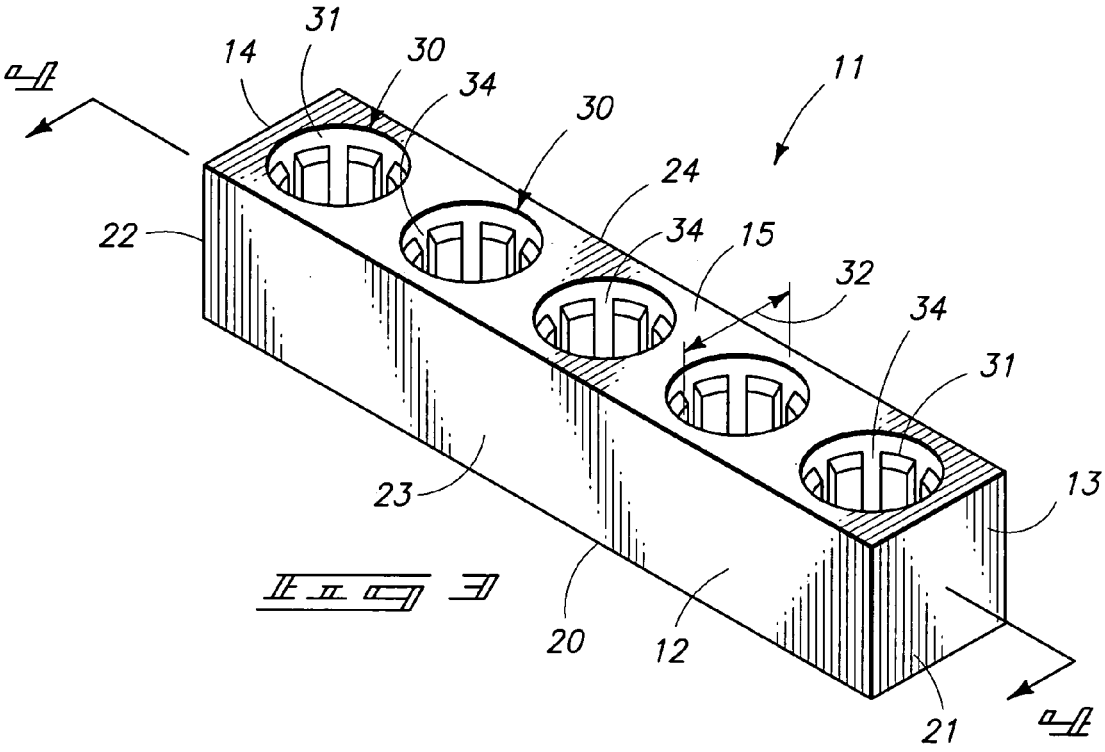
FIG. 3 is a perspective, side-elevation view of a construction element which is a feature of the present invention.
Figure 4:
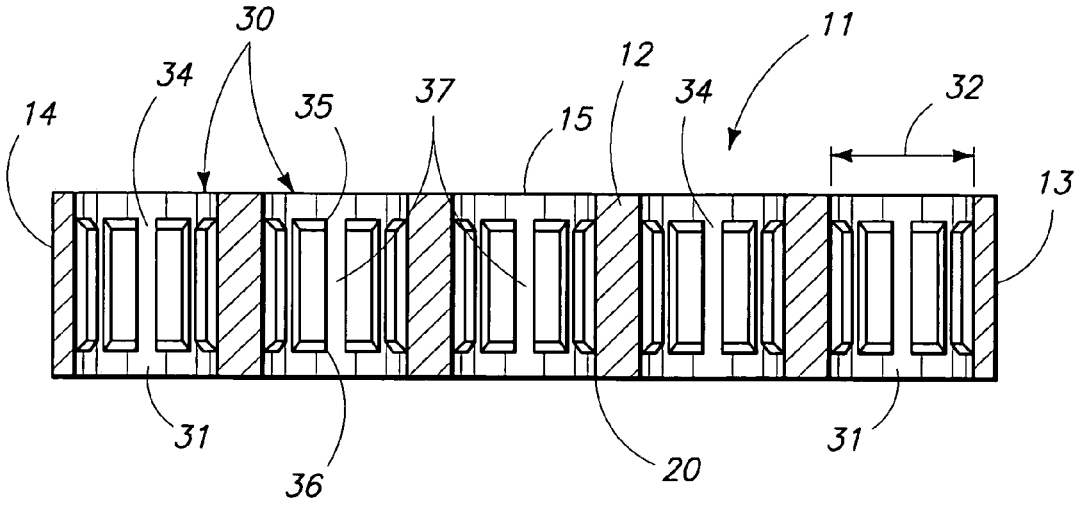
FIG. 4 is a transverse, vertical, sectional view of a construction element of the present invention and which is taken from a position along line 4-4 of FIG. 3.
Figure 5:
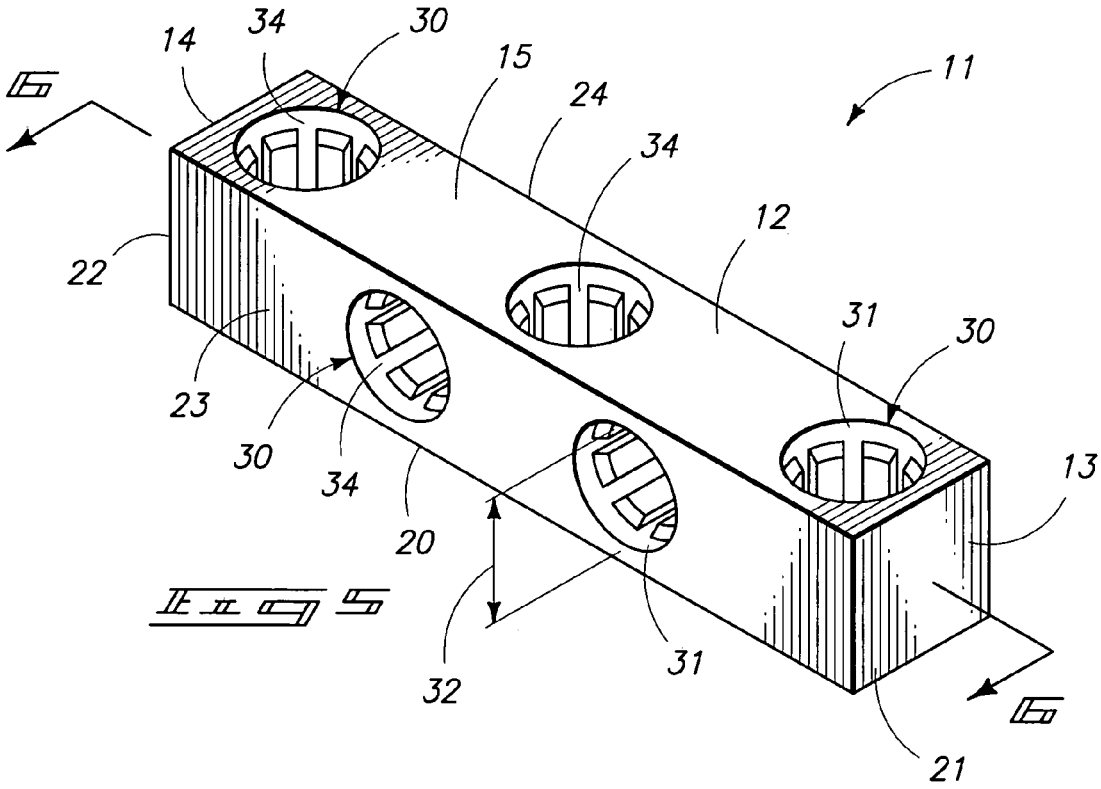
FIG. 5 is a perspective, side-elevation view of a second form of a construction element which is a feature of the present invention.
Figure 6:
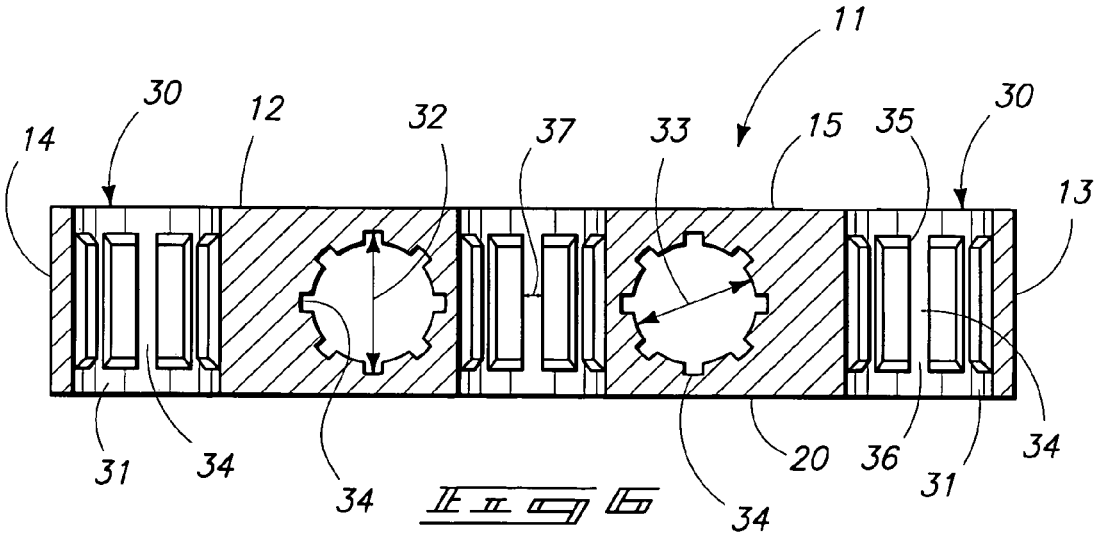
FIG. 6 is a transverse, vertical sectional view of the second form of the construction block as seen in FIG. 5, and which is taken from a position along line 6-6 of FIG. 5.

As seen in FIGS. 3-6, the construction element 11 is further defined by first, second, third and fourth sidewalls 21-24, respectively. As seen therein, the first and second sidewalls extend generally normally, downwardly relative to the top surface 15. As seen in FIGS. 3 and 4, the top and bottom surfaces 15 and 20, respectively are typically planer, however, in certain forms of the invention, the construction element 11 may have a curved or other geometric shape and consequently the top and bottom surfaces or the third and fourth sidewalls 23 and 24 may have different configurations, one relative to the other. In the construction system 10 of the present invention, the construction element 11 has at least one passageway 30 which extends therethrough. As seen in FIGS. 3-6, a plurality of passageways 30 are formed in the main body 12, and extend through the top surface 15 therethrough to the bottom surface 20. As seen in FIG. 5, the passageways may also include passageways which extend therethrough the third wall 23, main body 12, and through the fourth sidewall 24. As seen in FIGS. 5 and 6, the vertically disposed passageways 30 are positioned therebetween the substantially horizontally disposed passageways. For illustration purposes only, it should be recognized that the passageways may be in alternating, consecutive, or other arrangements based upon the construction element being designed. For example, it is conceivable that several horizontally oriented passageways 30 might be formed sequentially through the main body 12 followed by one vertically oriented passageway.

The passageway 30 which is formed through the main body 12 is defined by a sidewall 31 which defines a first maximum inside diametral dimension 32 for the passageway 30. Further, the sidewall defines a second minimum inside diametral dimension 33 as seen in FIG. 6. The second inside diametral dimension 33 is less than the first diametral dimension 32. Additionally, the passageway 30 defines at least one orientation groove 34 which extends, at least in part, through the construction element 11 and between the opposite sides of the construction element 11. As seen in FIGS. 4 and 6, and in one form of the invention, a plurality of orientation grooves 34 are formed in substantially equally spaced relation about the circumferential edge of the passageway. Each of the orientation grooves has a first end 35 and an opposite second end 36 (FIG. 4). Typically, each orientation groove has a length dimension which is less than the length dimension of the respective passageway 30, and a width dimension generally indicated by the numeral 37.

As seen in FIGS. 11 and 15, first and second construction elements here indicated as the numerals 11 and 11A, respectively can be fastened or otherwise moveably joined together by a fastener body 40 which will be described in greater detail hereinafter. While the present invention, as illustrated herein, shows two construction elements 11, and 11A cooperatively joined together, it should be recognized that the principles of the present invention can be applied to the design of other construction assemblies different than the first and second construction elements 11 and 11A as seen in FIGS. 11 and 15, respectively. More specifically, it should be appreciated that the respective construction elements may have different shapes and sizes than the elements 11, and 11A as shown in that view. In the arrangements as seen in FIGS. 11 and 15 a first construction element 11 has a first passageway 30 formed therein and which extends therethrough, and wherein a first orientation groove 34 communicates with, and extends, at least in part along, the first passageway. Still further, a second construction element 11A has a second passageway 30A formed therein, and which extends therethrough, and wherein a second orientation groove 34A communicates with and extends, at least in part, along the second passageway. As seen in the drawings, the first and second passageways 30 and 30A have substantially similar cross-sectional dimensions, and the fastener body 40 is operable to be received through the passageways 30 and 30A in a manner as described, below.

Referring more specifically to FIGS. 7-10, respectively, the construction system 10 (as seen in FIGS. 11 and 15) includes a fastener body which is generally indicated by the numeral 40. The fastener body 40 has a resiliently deformable first end 41, and an opposite, second end 42. Still further, the fastener body has an intermediate portion 43 which is located therebetween the first and second ends 41 and 42. The fastener body further has an exterior facing surface 44, and an opposite interior facing surface 45 which defines a longitudinally extending passageway 46 which extends between the first and second ends 41 and 42 thereof. As seen in FIGS. 7-10, respectively, a first discontinuous circumscribing flange 47 is formed at the first end 41. The first circumscribing flange has a circumscribing peripheral edge 48 which defines an outside diametral dimension which is typically less than the first inside diametral dimension 32 of the passageway 30, and greater than the second inside diametral dimension 33. As seen in the drawings, the fastener body 40 is further defined by a longitudinal axis which is generally indicated by the numeral 49. A second circumscribing flange 60 is formed or otherwise defined about the second end 42, and is further defined by a second circumscribing peripheral edge 61. Again, the second circumscribing edge defines an outside diametral dimension which is less than the first inside diametral dimension 32, and greater than the second inside diametral dimension 33. Still further, the intermediate portion 43 of the fastener body 40 has an outside diametral or cross-sectional dimension, which is less than about the second inside diametral dimension 33. As seen in FIG. 15, the fastener body 40 is telescopingly received, at least in part, into each of the first and second passageways 30 and 30A as defined by the respective construction elements 11 and 11A, respectively.

As seen in FIGS. 7-10, respectively, the first circumscribing flange 47 is defined by four discrete portions which are generally indicated by the numeral 62. These discrete portions are individually resiliently, and radially moveable relative to the longitudinal axes 49 of the fastener body 40 so as to facilitate the passage of the first end 41 through the respective passageways 30 and 30A which are defined by the respective construction elements 11 and 11A, respectively. The discrete portions 62 which define the second circumscribing flange 60 further define, at least in part, a pair of longitudinally extending channels 63 which are formed in the first end 41, and which extend generally in the direction of the second end 42. Still further, the fastener body 40 defines substantially oppositely disposed first guide channels 64 which substantially longitudinally extend from the first end 41 of the fastener body 40 in the direction of the second end 42 thereof. The first guide channels 64 communicate with the longitudinally extending passageway 46 which is defined by the interior facing surface 45. The first guide channel 64 has a length dimension which can be greater than about one-half the length dimension of the fastener body 40, although this length could be more or less than the stated length based upon the relative thickness dimensions of the construction elements 11 which are being joined together. The first guide channel has a first end 65, and an opposite second end 66. Still further, the fastener body 40 defines a second guide channel 70 which communicates with the first guide channel 64, and which has a first end 71 and an opposite second end 72. The first and second guide channels are generally perpendicular, one relative to the other. As will be seen, the first guide channel 64 has a width dimension 73, and the second guide channel 70 has a width dimension which is generally indicated by the line labeled 74. It should be understood, these width dimensions are generally substantially equal. The first and second guide channels define a course of movement for a locking member which will be discussed in greater detail, hereinafter.

Figure 7:
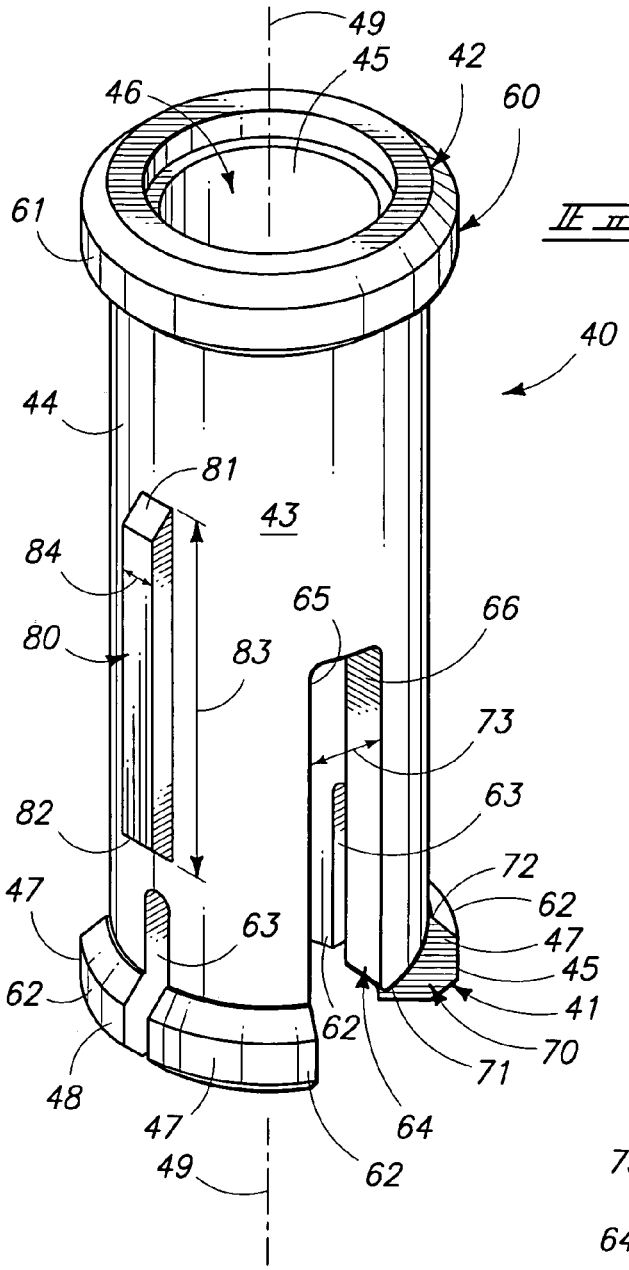
FIG. 7 is a perspective, side-elevation view of a fastener body which is a feature of the present invention.
Figure 8:
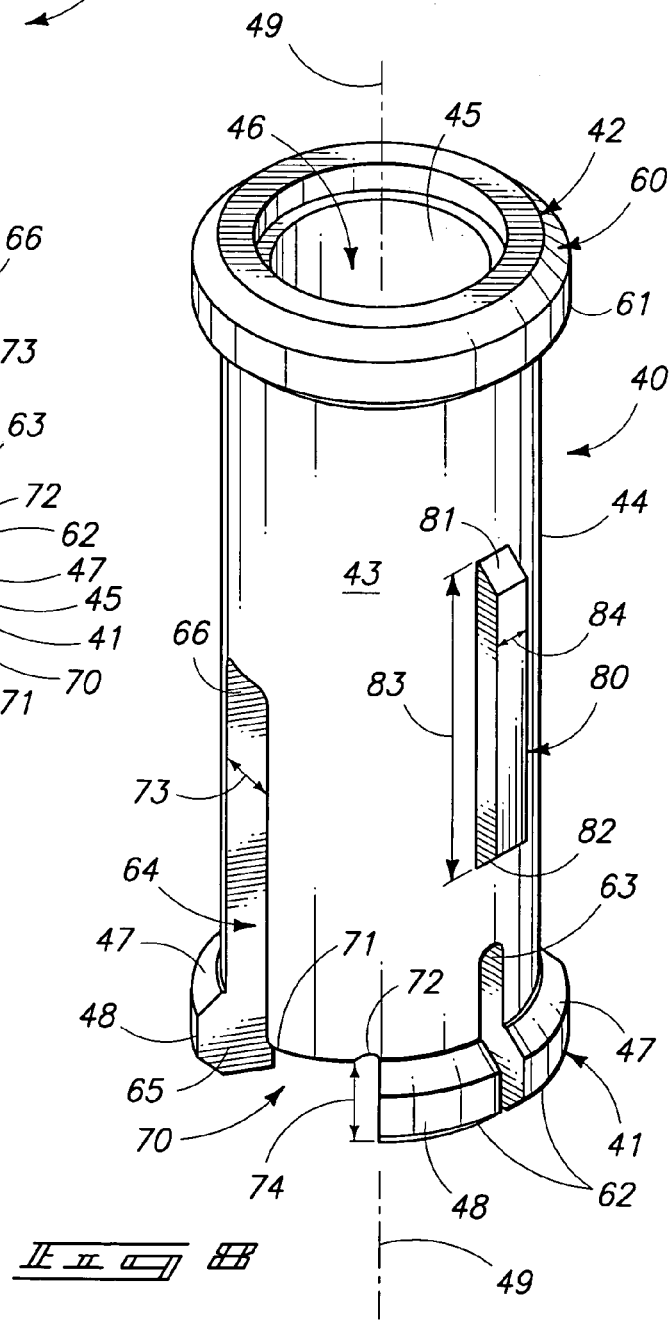
FIG. 8 is a second side-elevation view of the fastener body, and which is taken from a position opposite to that as seen in FIG. 7.
Figure 10:
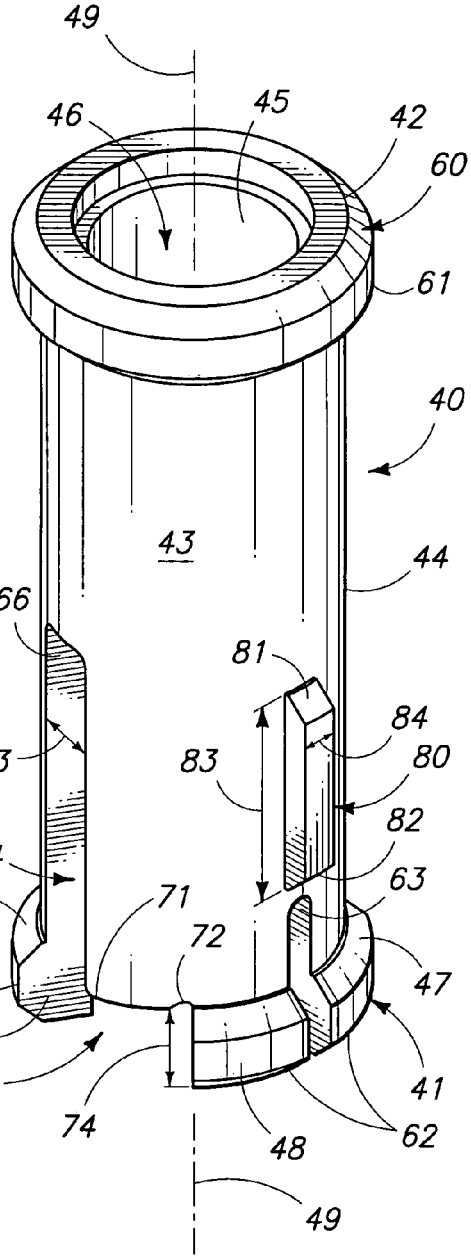
FIG. 10 is a perspective, side-elevation view of the fastener body which is taken from a position opposite to that as seen in FIG. 9.
Figure 9:
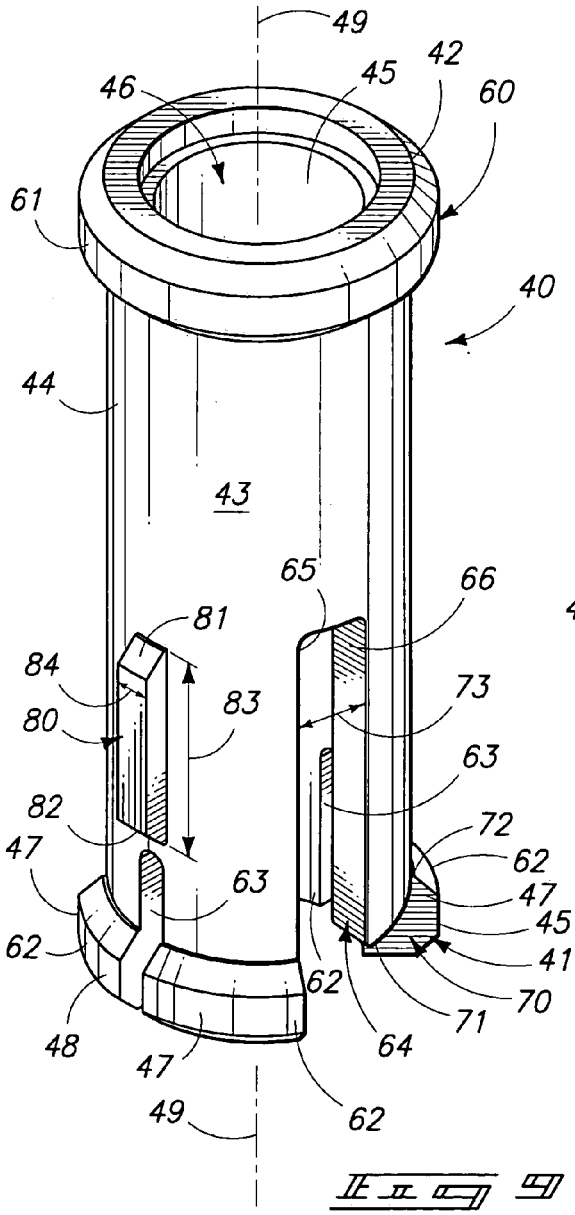
FIG. 9 is a perspective, side-elevation view of a second form of a fastener body which is a feature of the present invention.

Referring still to FIG. 7-10, respectively, it will be seen that the fastener body 40 further includes a tongue or orientation member 80 which is made integral with, and which extends substantially normally, outwardly relative to the exterior facing surface 44 of the intermediate portion 43 of the fastener body 40. As seen, the tongue has a first end 81; a second end 82; and a length dimension 83 which is measured between the first and second ends. Still further the tongue 80 has a width dimension which is generally indicated by the line labeled 84. As should be appreciated, the tongue 80 is dimensioned to be matingly and slideably received within at least one of the orientation grooves 34 which is defined within the passageway 30 or 30A, respectively. When received in one of the orientation grooves, the tongue is substantially operable to prohibit rotation of one of the construction elements 11 or 11A about the fastener body 40. As seen in FIGS. 7 and 9, respectively, the length dimension 83 of the tongue may be varied. As should be understood, the length dimension as seen in FIG. 7 can be long enough so that the tongue is received, at least in part, within an orientation groove 34 which is made integral with each of the construction elements 11 and 11A. When this is achieved, the respective construction elements 11 and 11A are fixedly, angularly positioned one relative to the other. Further, and when considering FIG. 9, it should be understood that in some forms of the invention, the tongue 80 may be of a length dimension where it is received in the orientation groove 34 of only one of the construction elements 11 or 11A, respectively. In this arrangement, the construction element receiving the tongue 80 within the orientation groove 34 would be fixedly positioned relative to the fastener body 40. However, the second construction element (11 or 11A) which did not receive the tongue 80, would be free to rotate thereabout the fastener body 40.

As should be understood, from the discussion, above, the fastener body 40 may be fabricated in some forms of the invention where no tongue 80 is present at all. If this type of fastener body was fabricated, then both construction elements 11 and 11A would be freely rotatable thereabout the fastener body 40. Therefore, the tongue 80 is operable to be received within at least one of the orientation grooves 34, and thereafter, the tongue 80 substantially prohibits rotation of one of the construction elements 11 or 11A about the fastener body 40; and if received in the orientation grooves 34 of both construction elements 11 and 11A, then the tongue 80 is operable to substantially fixedly and angularly orient the first mentioned construction element 11 relative to the second construction element 11A as seen in FIG. 15. In the arrangement as seen in FIG. 7-10, two tongues are shown in the drawings. However, it should be understood, that a single tongue 80 may be successfully utilized in certain applications. As should be appreciated from the drawings, the width dimension 84 of the tongue 80 is less than about the width dimension 37 of the individual orientation grooves 34, thereby allowing the tongue 80 to pass therethrough.

Figures 1, 2:
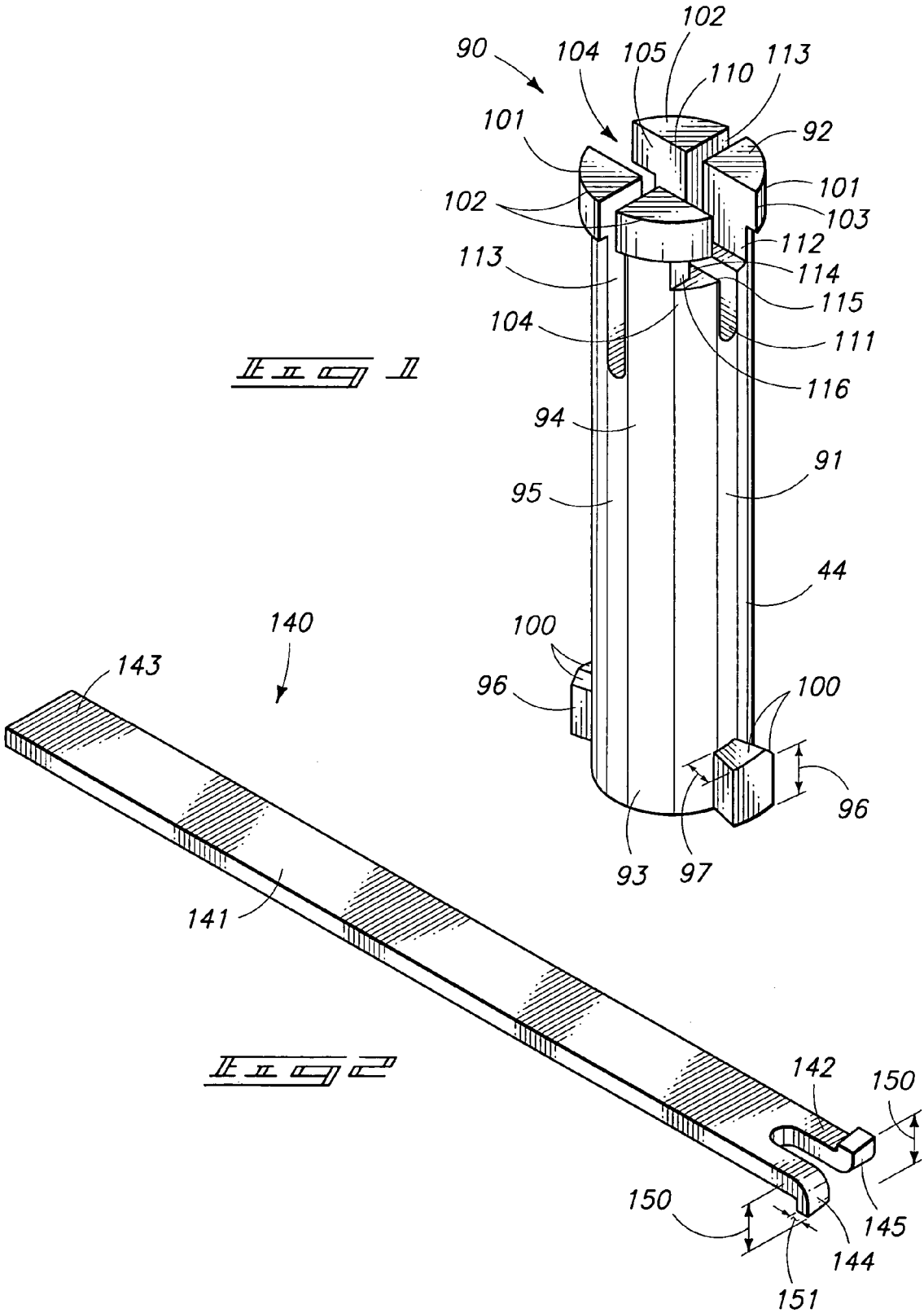
FIG. 1 is a perspective, side-elevation view of a locking member which is a feature of the present invention.
FIG. 2 is a perspective, side-elevation view of a tool which is useful in combination with the locking member as seen in FIG. 1.

Referring now to FIGS. 1, 11, 12, 13, 14 and 15, it will be seen that the construction system 10 of the present invention includes a locking member which is generally indicated by the numeral 90, and which matingly cooperates with the fastener body 40. As will be seen in the drawings, the locking member 90, when located in a first position (FIG. 12), allows the fastener body 40 to be telescopingly received, at least in part, within the passageway 30 defined by one of the construction elements 11 or 11A; and in a second position (FIGS. 13 and 14) substantially impedes the removal of the fastener body 40 from the passageway 30 as defined by one of the construction elements 11 or 11A. As will be seen in FIGS. 12 and 13, the locking member 90 is telescopingly received, at least in part, within the passageway 46 which is defined by the fastener body 40. Referring now to FIG. 1, the locking member 90 has a main body 91 which is defined by a first end 92, and an opposite second end 93. Still further, the locking member 90 has an exterior facing surface 94, and an intermediate portion 95. As illustrated in the drawings, a pair of posts which are generally indicated by the numeral 96 extend generally normally, outwardly relative to the second end 93 thereof. The pair of posts have a radial dimension 97 (FIG. 1) which is less than about the thickness dimension as defined between the exterior facing surface 44, and the interior facing surface 45 of the fastener body 40. In this arrangement, the respective posts when properly cooperating with the fastener body 40 do not extend beyond the exterior facing surface 44 of the fastener body. The respective posts 96 each have a top peripheral edge 100 which is operable to matingly cooperate with the second distal end 72 of the second guide channel 70 for the purposes which will be described in greater detail hereinafter.

As best appreciated by a study of FIG. 1, and following, the locking member 90 includes a circumscribing flange 101 which is positioned about the first end 92 thereof. The circumscribing flange defines a plurality of resiliently and radially deformable portions 102. As should be understood, the circumscribing flange defines a peripheral edge 103 which has an outside diametral dimension which is less than about the first inside diametral dimension 32 of the passageway 30. The resiliently and radially deformable portions 102 provide a means by which the locking member 90 can be telescopingly received through the passageway 46 which is defined by the fastener body 40, and is further moveable relative thereto as will be described, hereinafter. As will be understood by a study of FIG. 1, and following, the outside diametral dimension of the circumscribing flange 101 is greater than the outside diametral dimension of the intermediate portion 95 of the locking member 90. In this regard, the outside diametral dimension of the intermediate portion of locking member 95 is less than about the second inside diametral dimension 33, of the passageway 30 as defined by the respective construction elements 11 or 11A, respectively.

The locking member 90 defines a tool engagement cavity (FIG. 1) which is generally indicated by the numeral 104, and which is located at the first end 92 thereof. The tool engagement cavity 104 has a first portion 105, which is defined by a generally longitudinally extending channel having a first end 110; an opposite, second end 111; and an intermediate portion 112. The first portion 105 of the tool engagement cavity 104 has dimensions which permits it to matingly receive, and allows the passage of a tool (FIG. 2) which is operable to impart linearly, outwardly and rotational movement to the locking member 90, for the purposes which will be described below, and along the first and second guide channels 64 and 70, respectively, which are defined by the fastener body 40. As illustrated in FIG. 1 and following, the tool engagement cavity is further defined by a generally longitudinally extending passageway 113 which is formed the first end 92, and which communicates with the first portion 105 of the tool engagement cavity 104. This longitudinally extending passageway 113 is disposed generally normally, relative to the orientation of the first portion 105 thereby defining the resiliently, and radially deformable portions 102 which facilitate the passage of the first end 92 of the locking member 90 through the passageway 46 as defined by the fastener body 40. This is best understood by a study of FIG. 11. In addition to the foregoing, the tool engagement cavity 104 has a second portion 114 (FIG. 12) which is formed in the end 92, and which is generally circumscribingly oriented relative to the locking member 90, and generally perpendicular to the orientation of the first portion 105 of the tool engagement cavity 104. The second portion of the tool engagement cavity has a first end 115; a second end 116; and is further operable to matingly cooperate with a tool (FIG. 2), which will be described below, and which can impart longitudinally outward force substantially along the longitudinal axis 49 of the fastener body 40, and further may rotate the locking member relative to the fastener body 40 (FIGS. 13 and 14).

Figure 12:
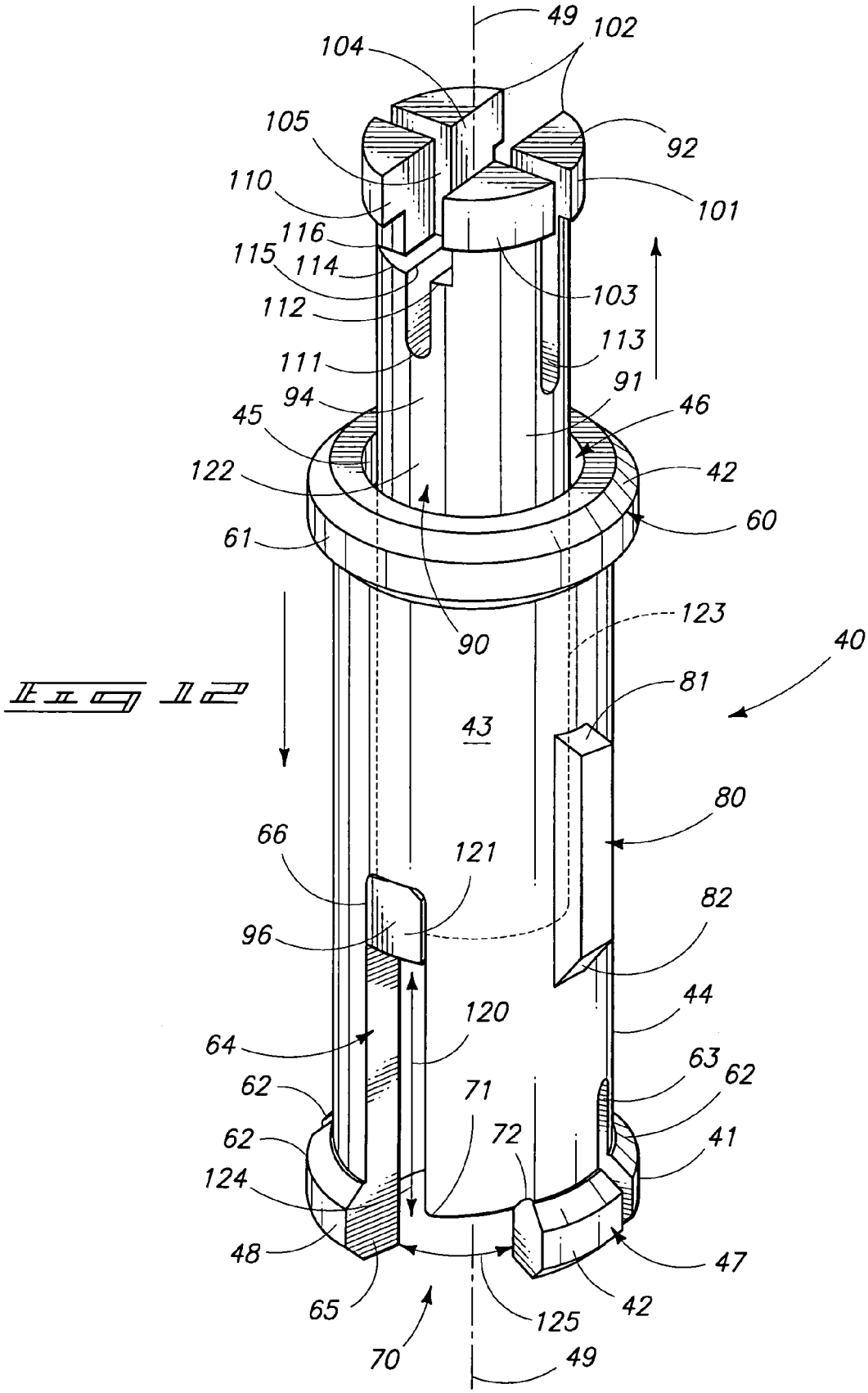
FIG. 12 is a fragmentary, side-elevation view of a fastener body, and locking member which is utilized in the construction system of the present invention, and which is shown in a first operational position.
Figure 13:
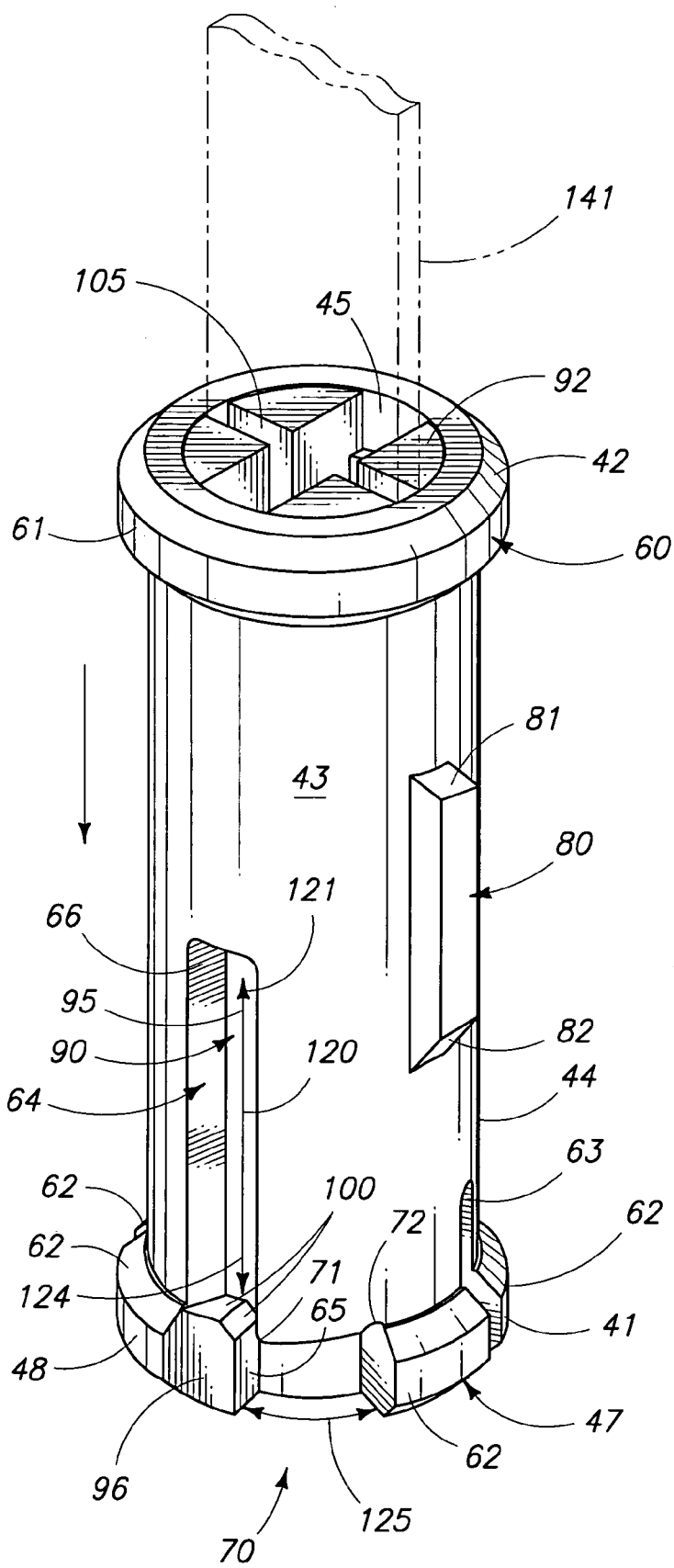
FIG. 13 is a perspective, side-elevation view of a fastener body and locking member which is utilized in the construction system of the present invention, and which is shown in a second operational position.
Figure 11:
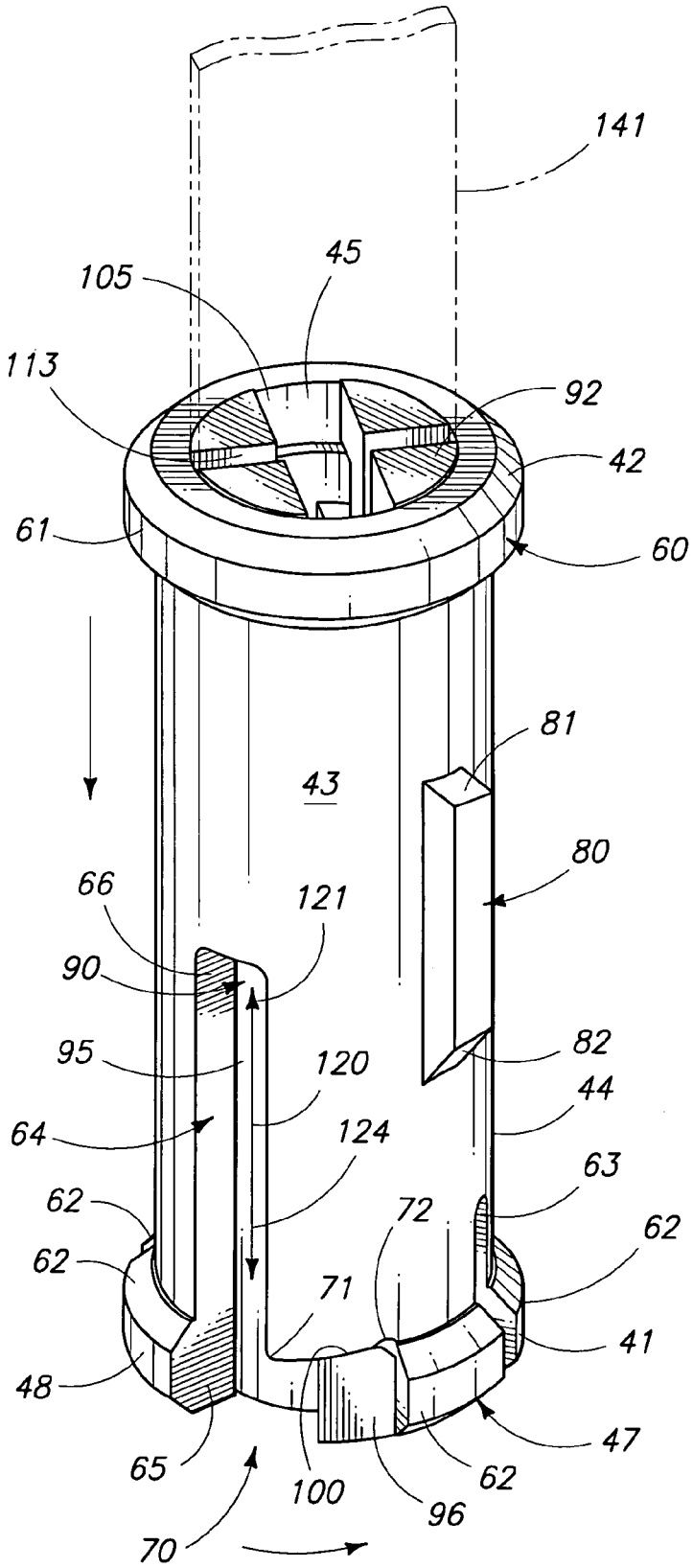
Figure 11:
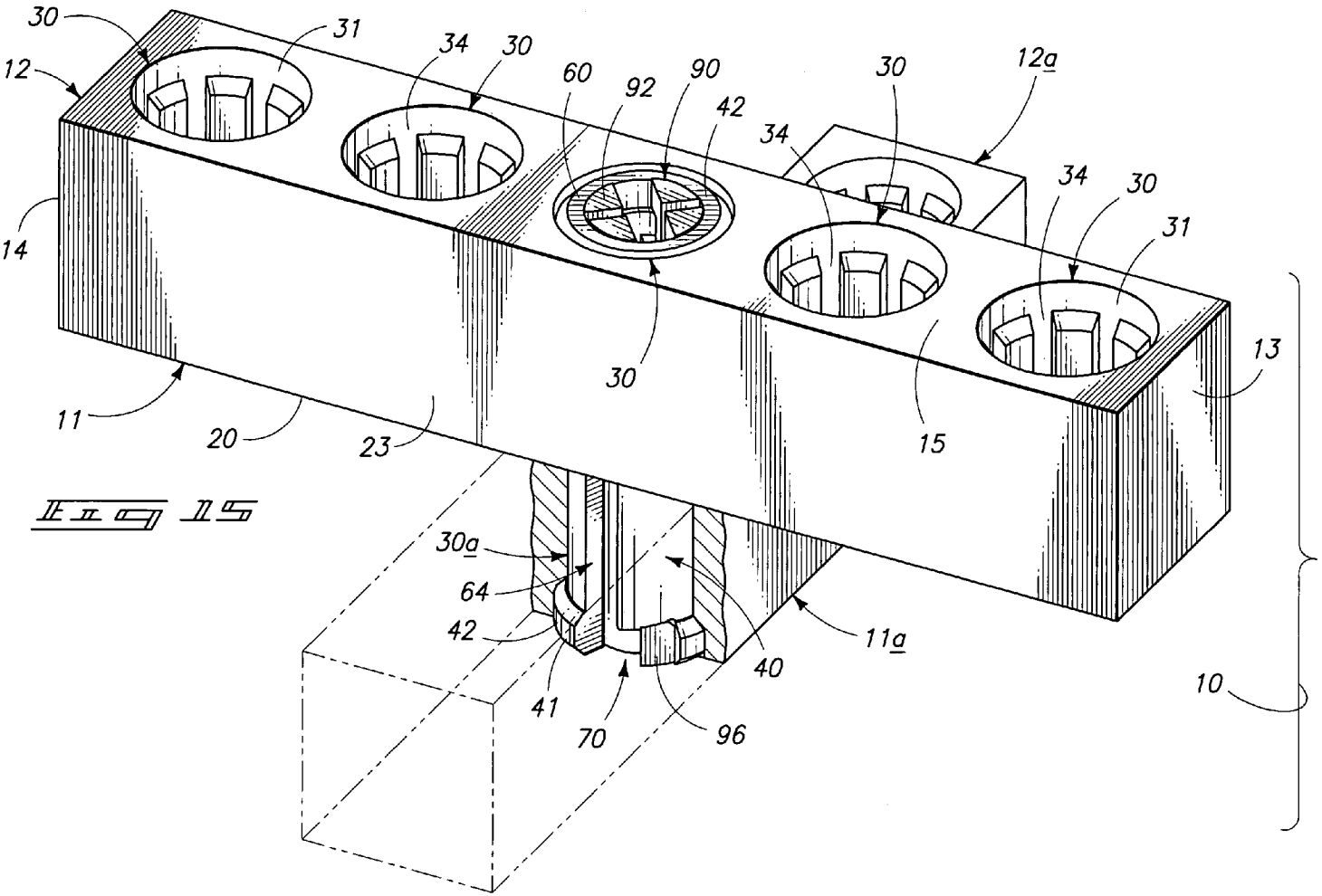

As best understood by FIGS. 12-14, the locking member 90 is telescopingly received, at least in part, within the longitudinally extending passageway 46 as defined by the fastener body 40. The locking member 90 is coaxially moveable along a first substantially linear path or course of travel 120 from a first position 121, and wherein a first portion 122 of the locking member 90 extends longitudinally outwardly relative to the second end 42 of the fastener body 40 (as seen in FIG. 12); and a second portion 123 of the locking member 90 is received in the longitudinally extending passageway 46 as defined by the fastener body 40, and is located intermediate the first and second ends 41 and 42 thereof. Still further, the locking member 90 is moveable to a second position 124, and wherein the locking member 90 is substantially wholly received within the passageway 46. This is seen by reference to FIG. 13. When located in the second position 124, the locking member 90 is further at least partially coaxially rotatable relative to the passageway 46. This rotation of the locking member 90 is facilitated by the passage of the post 96 along the second guide channel 70 which defines a second, partially rotatable course of movement 125 (FIG. 13). As should be understood from the drawings, the first guide channel 64 defines the first substantially linear path of travel 120 between the first position 121 and the second position 124. As seen, by reference to FIGS. 13 and 14, and when moved along the second guide channel 70 which defines the second course of movement 125, the post 96 is operable to matingly cooperate with the distal end 72 of the second guide channel in the nature of a snap-fit thereby releaseably securing the locking member 96 in an appropriate position. When the locking member 90 is wholly received within the passageway 46, as defined by the fastener body 40, it substantially impedes the removal of the fastener body from the passageways 30 which are defined by the respective construction elements 11 because it substantially prevents the radial deformation of the first end 41 of the fastener body 40. Still further, and when located in the first position 121, the locking member 90 allows the first end 41 of the fastener body 40 to be resiliently deformed so as to facilitate the movement of the first end 41 of the fastener body 40 through the passageways 30 as defined by the first and second construction members 11 and 11A, respectively.

The linear and rotational movement of the locking member 90 is implemented by a tool 140 which matingly engages, and is received within the tool engagement cavity 104. As seen in FIG. 2, the tool 140 has an elongated main body 141 with opposite first and second ends 142 and 143, respectively. As should be understood, the second end 143 is grasped by the hand of an operator, and who may then apply linear as well as rotational force along the longitudinal axis of the tool 140 in order to cause the corresponding rotation of the locking member 90, as will be described below. In this regard, the first end 142 of the tool is defined by first and second engagement members 144 and 145, respectively. The first end 142 has a width dimension which is generally indicated by the line labeled 150. This width dimension of the first end of the tool is less than about the width dimension of the first portion 105 of the tool engagement cavity 104. This permits the first end 142 of the tool to be inserted into the first portion 105 of the tool engagement cavity. Still further, limited rotation of the tool 140 causes the first and second engagement members 144 and 145, respectively to be received in the second portion 114 of the tool engagement cavity. As should be understood, the respective first and second engagement members have a thickness dimension indicated by the line labeled 151. This thickness dimension is less than about the width dimension of the second portion 114, thereby allowing the first and second engagement members to be received within the second portion 114, and be positioned below a portion of the circumscribing flange 101. By counter-clockwise rotation of the tool 140, rotational force can be applied to the locking member 90 thereby rotating it in a fashion so that the post 96 may move along the second guide channel 70, to the distal end 72 thereof. Clockwise rotation causes the post 95 to be moved in the opposite direction. Further, and when the post 96 is oriented in the second position 124, the tool 140 is operable to exert substantially coaxially and linear force to the locking member 90 so as to move the locking member 90 from the second position 124 to the first position 121. In some forms of the invention, the orientation of second guide channel 70 may be in the opposite direction from that seen in the drawings. Consequently, the rotations discussed above may be in the opposite direction from that described.

Therefore the tool 140 has a proximal or a first end 142 which is sized to be received within the tool engagement cavity 104. As seen in FIG. 1, the first portion 105 of the tool engagement cavity 104 permits substantial coaxially and linear movement of the proximal or first end 142 of the tool 140 into the tool engagement cavity, and the second portion 114 of the tool engagement cavity permits the proximal or first end of the tool 142 to be substantially coaxially rotatable (in a limited fashion) relative to the first end 92 of the locking member 90. Further, the tool 140, when received in the tool engagement cavity 104 is operable to selectively move the locking member 90 along the first and second guide channels 64 and 70, respectively. As noted above, the tool 140 is operable to exert rotatable and linearly outward force on the first end 92 of the locking member 90 so as to move the locking member from the second position 124 to the first position 121 relative to the fastener body 40. As should be understood, in the first position 121, the continued application of linear outward force on the first end 92 of the locking member 90 results in withdrawal of the fastener body 40 from the first and second passageways 30 and 30A, and which is defined by the respective construction elements 11 and 11A. As should be understood, the circumscribing flange 101 which is found at the first end 92 of the locking member 90 substantially prevents the main body 91 from being pushed substantially through the passageway 46 which is defined by the fastener body 40. This is best understood by a study of FIG. 15.

Figure 16:
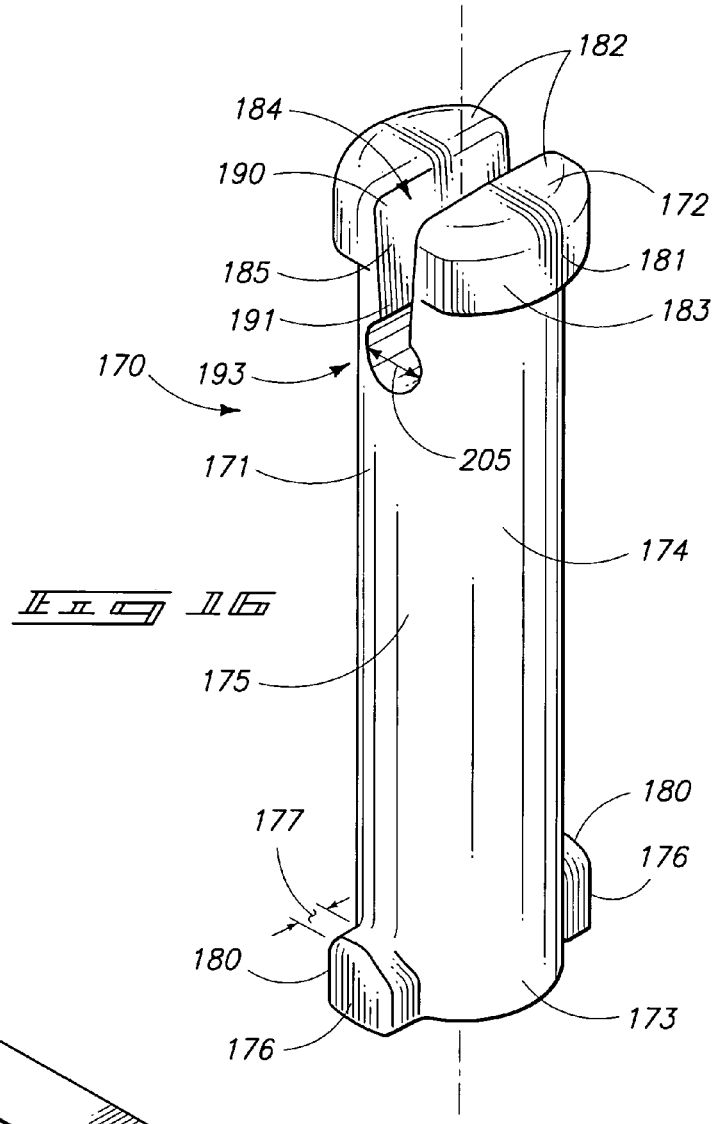
FIG. 16 is a perspective, side elevation view of a second form of a locking member which is a feature of the present invention.

Referring now to FIG. 16, it will be seen that the construction system 10 of the present invention includes a second form of the locking member and which is generally indicated by the numeral 170, and which matingly cooperates with the fastener body 40. As will be understood from the previous discussion, the locking member 170 operates in a similar fashion to that described for the locking member 90. More specifically, the locking member 170, when located in a first position, allows the fastener body 40 to be telescopingly received, at least in part, within the passageway 30 defined by one of the construction elements 11 or 11A; and in a second position substantially impedes the removal of the fastener body 40 from the passageway 30 as defined by one of the construction elements 11 or 11A. As was the case with the locking member 90, the second locking member 170 is telescopingly received, at least in part, within the passageway 46 which is defined by the fastener body 40. Referring now to FIG. 16, the locking member 170 has a main body 171 which is defined by a first end 172, and an opposite second end 173. Still further, the locking member 170 has an exterior facing surface 174, and an intermediate portion 175. As illustrated in FIG. 16, a pair of posts which are generally indicated by the numeral 176 extend generally normally, outwardly relative to the second end 173 thereof. The pair of posts have a radial dimension 177 which is less than about the thickness dimension as defined between the exterior facing surface 174, and the interior facing surface 45 of the fastener body 40. In this arrangement, the respective posts when properly cooperating with the fastener body 40 do not extend beyond the exterior facing surface 44 of the fastener body. The respective posts 176 each have a top peripheral edge 180 which is operable to matingly cooperate with the second distal end 72 of the second guide channel 70 for the purposes which will be described in greater detail hereinafter.

As best appreciated by a study of FIG. 16, the locking member 90 includes a circumscribing flange 181 which is positioned about the first end 172 thereof. The circumscribing flange is discontinuous and defines two resiliently and radially deformable portions 182. As should be understood, the circumscribing flange defines a peripheral edge 183 which has an outside diametral dimension which is less than about the first inside diametral dimension 32 of the passageway 30. The resiliently and radially deformable portions 182 provide a means by which the locking member 90 can be telescopingly received through the passageway 46 which is defined by the fastener body 40, and is further moveable relative thereto as will be described, hereinafter. As will be understood by a study of FIG. 1, and following, the outside diametral dimension of the circumscribing flange 181 is greater than the outside diametral dimension of the intermediate portion 175 of the locking member 170. In this regard, the outside diametral dimension of the intermediate portion of locking member 175 is less than about the second inside diametral dimension 33, of the passageway 30 as defined by the respective construction elements 11 or 11A, respectively.

Still referring to FIG. 16, the locking member 170 defines a tool engagement cavity which is generally indicated by the numeral 184, and which is located at the first end 92 thereof. The tool engagement cavity 184 has a first portion 185, which is defined by a generally longitudinally extending channel having a first end 190; and an opposite, second end 191. Additionally, the tool engagement cavity has a somewhat cylindrically shaped second portion 193. The first portion 185 of the tool engagement cavity 184 has dimensions which permits it to matingly receive, and allows the passage of a tool (FIG. 17) into the second portion 193. When received in the second portion 193, the tool is operable to impart linearly, outwardly and rotational movement to the locking member 170, for the purposes which will be described below, and along the first and second guide channels 64 and 70, respectively, which are defined by the fastener body 40.

Figure 17:
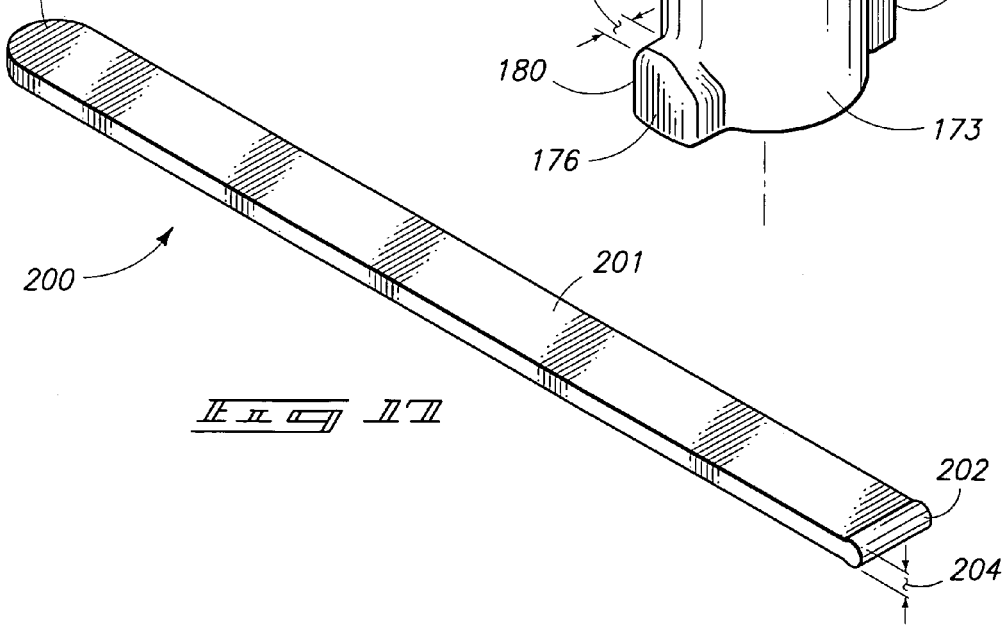
FIG. 17 is a perspective, side elevation view of a second form of a tool which is useful in combination with the locking member as seen in FIG. 16.

Referring now to FIG. 17, a tool which is designated 200 is operable to matingly cooperate with, and otherwise be received within the tool engagement cavity 184. Once it is appropriately seated in the tool engagement cavity 184, the tool 200 is operable to impart rotational, as well as linearly inwardly and/or outward force on the main body 171 of the locking member 170 to cause it to operate in a fashion which is substantially similar to the locking member 90. The tool 200 has a main body 201 which is defined by a first end 202 which is received in the tool engagement cavity 184, and an opposite second end 203. The second end 203 is grasped by the hand of an operator (not shown), and who would impart rotational or linear inward or outward force to the main body 201, and which would be imparted to the main body 171 of the locking member 170. As seen in FIG. 17, the first end 202 is generally cylindrically shaped and has an outside diametral dimension designated by the numeral 204. As should be understood from FIG. 16, the second end 191 of the channel 185 has a width dimension which is less than the outside diametral dimension of the first end 202. Further, the second portion 193 of the tool engagement cavity 184 has an inside diametral dimension 205. As will be understood, the first end 202 of the tool is received in the second portion of the tool engagement cavity in the manner of a snap-fit because of the radial resiliency of the deformable portions 182. In all other respects, the second form of the locking member 170 operates substantially similarly to the locking member 90.

The respective construction elements 11 and 11A may be fabricated from natural materials such as metal (aluminum), wood, or other cellulosic materials and/or synthetic materials of various sorts such as nylon, plastics and other moldable materials. Still further, the fastener body 40 as well as the locking member 90 may be fabricated, at least in part, of a metal and/or a plastic.

OPERATION

The operation of the described embodiment of the present invention is believed to be readily apparent and is briefly summarized at this point.

In its broadest aspect, a construction system 10 of the present invention includes, a construction element 11 which has at least one passageway 30 which extends therethrough; and which further includes a fastener body 40 telescopingly received, at least in part, in the passageway 30, and which extends, at least in part, outwardly relative to the construction element 11. This is best understood by reference to FIG. 15. Still further, the construction system 10 includes a locking member 90 cooperating with the fastener body 40 and which, in a first position 121, allows the fastener body 40 to be telescopingly received, at least in part, within the passageway 30 defined by the construction element 11, and in a second position 124, substantially impedes the removal of the fastener body 40 from the passageway 30 which is defined by the construction element 11. This is seen most clearly by reference to FIGS. 13-15, respectively. As should be understood, in the second position 124, the locking member substantially impedes the resilient deformation of the first end 41 of the fastener body 40 thereby securing the fastener body within the passageway 30.

More specifically, the construction system 10 of the present invention includes a first construction element 11 having a first passageway 30 formed therein and which extends therethrough. Still further, a first orientation groove 34 is defined by the first construction element, and communicates with and extends, at least in part, along the first passageway 30. Still further, the construction system includes a second construction element 11A having a second passageway 30A formed therein. The second passageway extends therethrough, and a second orientation groove 34A communicates with, and extends, at least in part, along the second passageway 30A. The first and second passageways 30, 30A have substantially similar cross sectional dimensions and are generally cylindrical in shape. The construction system 10 of the present invention includes a fastener body 40 having a resiliently deformable first end 41, and an opposite second end 42. Still further, the fastener body 40 has an intermediate portion 43 located between the first and second ends 41 and 42. The fastener body defines a longitudinally extending passageway 46 which extends between the first and second ends 41 and 42. The fastener body 40 has a cross sectional or outside diametral dimension at the first and second ends which is less than about the first or largest inside dimension 32 of the respective passageways 30 and 30A, and is further larger than the smallest inside diametral dimension 33. Still further, the intermediate portion 43 has a cross sectional or outside diametral dimension which is less than the smallest cross sectional or inside diametral dimension 33 of the respective passageways 30, 30A as defined by the respective first and second construction element 11 and 11A. In the arrangement as seen in the drawings, the fastener body 40 is telescopingly received, at least in part, in each of the first and second passageways 30 and 30A as defined by the respective construction elements 11 and 11A. Still further, a tongue 80 (in some forms of the invention) is made integral with the intermediate portion 43 of the fastener body, and extends radially outwardly relative thereto. The tongue is received, at least in part, in at least one of the first or second orientation grooves 34 or 34A. The tongue 80 substantially impedes the rotation of the first and/or second construction members 11 and 11A about the intermediate portion 43 of the fastener body 40.

A locking member 90 having a main body 91 with opposite first and second ends 92 and 93, respectively is telescopingly received within the longitudinally extending passageway 46 as defined by the fastener body 40. In this regard, the first end 92 of the locking member 90 is received in the first end of the fastener body, and is pushed through the passageway 46 until the first end 92 extends longitudinally, outwardly relative to the second end 42 of the fastener body 42 (FIGS. 11 and 12). The locking member 90 moveably and matingly cooperates with the fastener body 40 as shown in FIGS. 12-14. In this regard, the main body 91 of the locking member 90 is linearly and rotatably moveable along a first course of travel defined by the fastener body 40 from a first position 121 which permits the first end 41 of the fastener body 40 to be deformed and pass through the respective first and second passageways 30 and 30A as defined by the first and second construction elements 11 and 11A, respectively. Still further, the passage of the first end 41 through the passageways 30 and 30A causes the intermediate portion 43 of the fastener body 40 to be received within each of the respective first and second passageways 30 and 30A as defined by the respective first and second construction elements 11 and 11A. Still further, when the locking member 90 is positioned in a second position 124, the locking member is wholly received within the longitudinally extending passageway 46 as defined by the fastener body (FIG. 13). In this position, the locking member impedes the removal of the fastener body 40 from the first and second passageways 30 and 30A by impeding the resilient deformation of the first end 41 of the fastener body 40. As earlier disclosed, the fastener body 40 has a longitudinal axis 49, and a deformable first end 41. The deformable first end 41 includes at least one portion 62 which is resiliently, radially moveable relative to the longitudinal axis 49 of the fastener body.

In the arrangement as seen in the drawings, the locking member 90 has a main body 91 which is defined by an exterior facing surface 94. Still further, a post 96 extends radially outwardly relative to the second end 93 thereof. In the arrangement as seen in FIG. 12, the fastener body 40 further defines a first guide channel 64 which matingly receives, and defines a first course of movement 120 for the locking member 90 when force is applied to the first end 92 thereof (FIG. 14). The first guide channel 64 extends from the first end 41 of the fastener body 40 in the direction of the second end 42 thereof. In the arrangement as seen in FIG. 12, the first end 41 of the fastener body 40 defines a second guide channel 70 which communicates with the first guide channel 64, and which matingly receives, and defines a second course of movement 125 for the locking member 96. In this regard, the first guide channel 64 causes the locking member to move substantially linearly relative to the fastener body 40, and the second guide channel 70 causes the locking member 90 to be partially, rotatably moveable relative to the fastener body 40.

In the arrangement as seen in FIGS. 12 and 13, the second guide channel 70 has a second or distal end 72 which matingly cooperates with the post 96 so as to releasably secure the locking member in a position which impedes the removal of the fastener body 40 from the first and second passageways 30 and 30A as defined the respective construction elements 11 and 11A. As disclosed, the first end 92 of the locking member 90 defines a tool engagement cavity 104 having first and second portions 105 and 114, respectively, and which communicate together. Still further, a tool 140 is provided and which has a first or proximal end 142 which is sized to be received within the tool engagement cavity 104. The tool 140, when received in the tool engagement cavity, is operable to selectively move the locking member 90 along the first and second guide channels 64 and 70, respectively. Additionally, the tool 140 is operable to exert rotatable and linearly outward force on the first end 92 of the locking member 90 so as to reciprocally move the locking member 90 from the second 124 to the first positions 121 relative to the fastener body 40. As earlier discussed, when located in the first position 121, the fastener body 40 may be inserted or withdrawn from the passageway 30.

Therefore, it will be sent that the construction system 10 of the present invention is simple in operation and allows a multitude of construction elements to be joined in a fashion not possible heretofore. The present invention further avoids many of the shortcomings attendant with the prior art practices and other assemblies which have been used for similar purposes heretofore.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A construction system, comprising:

a first construction element having a first passageway formed therein, and which extends therethrough, and which defines a first plurality of orientation grooves which are located in spaced relation one relative to another;

a second construction element having a second passageway formed therein, and which extends therethrough, and which defines a second plurality of orientation grooves which are located in spaced relation one relative to another, and wherein the first and second construction elements are juxtaposed one relative to the other such that the first and second passageways are substantially coaxially aligned;

a fastener body wholly and telescopingly received within the first and second passageways, and which has an exterior facing surface and an opposite interior facing surface, and wherein the fastener body has a tongue which extends radially outwardly from the exterior facing surface, and wherein the tongue is received in one of the first and second plurality of orientation grooves and substantially impedes the rotation of the first and second construction elements relative to each other, and wherein the fastener body further defines a first guide channel which extends generally longitudinally and linearly along the fastener body and which extends from the exterior facing surface to the interior facing surface, and a second guide channel which is substantially perpendicular relative to, and further communicates with, the first guide channel and which extends from the exterior facing surface to the interior facing surface; and a locking member wholly and telescopingly received within the fastener body and which further has a main body defined by an exterior facing surface, and wherein a post extends normally outwardly relative to the exterior facing surface of the main body, and wherein the first and second guide channels of the fastener body slideably receive the post, and facilitate the substantially linear movement of the locking member from a first position wherein a first portion of the locking member extends longitudinally outwardly relative to the fastener body to a second position wherein the locking member is received completely within the fastener body and wherein the exterior facing surface of the main body of the locking member is substantially immediately adjacent to the interior facing surface of the fastener body, and wherein the locking member is moved to the second position without rotation, and is partially rotatable when located in the second position so as to facilitate movement of the post along the second guide channel to a locked position, and wherein the first and second construction elements are affixed together when the locking member is in the second position such that the first and second construction elements are oriented in a fixed and locked position with respect to one another at one of at least four relative angular positions which are defined by the respective first and second orientation grooves that receives the tongue of the fastener body.

2. A construction system as claimed in claim 1, and wherein the fastener body has a resiliently deformable first end, and a second end, and wherein the locking member cannot be withdrawn from the fastener body through the second end thereof.

3. A construction system as claimed in claim 2, and wherein the locking member has a first end which defines a circumscribing flange with a plurality of resiliently and radially deformable portions, and an opposite second end, and wherein the first end of the locking member is wholly inserted into the fastener body, through the second end thereof, such that the first end of the locking member is undeformed when positioned within the first end of the fastener body.

4. A construction system as claimed in claim 3, and wherein the first guide channel of the fastener body has a first end, and an opposite second end, and wherein the post of the locking member is located substantially immediately adjacent to the second end of the first guide channel when the locking member is in the first position, and wherein the fastener body and the locking member are removed from the first and second passageways defined by the first and second construction elements when an outward, substantially linear, and non-rotational pulling force is applied to the first end of the locking member.

5. A construction system as claimed in claim 4, and wherein the locking member defines a tool engagement cavity, and wherein the outward pulling force is applied by an engagement tool received within the tool engagement cavity.

* * * * *